US005078573A

United States Patent [19]

Peroaho et al.

[11] Patent Number: 5,078,573

[45] Date of Patent: Jan. 7, 1992

[54] LIQUID RING PUMP HAVING TAPERED BLADES AND HOUSING

[75] Inventors: Tapio Peroaho, Tavastila; Reijo Vesala, Kotka; Vesa Vikman, Kymi, all of Finland

[73] Assignee: A. Ahlstrom Corporation, Noormarkku, Finland

[21] Appl. No.: 579,402

[22] Filed: Sep. 7, 1990

[51] Int. Cl.[5] ..... F01D 11/00

[52] U.S. Cl. ..... 415/169.1; 415/143; 415/182.1; 416/223 A; 417/69; 55/52; 55/203

[58] Field of Search ..... 417/68, 69; 415/143, 415/169.1, 182.1, 206, 203; 416/179, 223 R, 223 A, 223 B; 55/1, 52, 199, 203

[56] References Cited

U.S. PATENT DOCUMENTS

| | | | |
|---|---|---|---|
| 2,581,055 | 1/1952 | Wahle | 415/206 |
| 3,519,365 | 7/1970 | Conhagen | 415/143 |
| 4,111,597 | 9/1978 | Grossi et al. | 415/143 |
| 4,776,758 | 10/1988 | Gullichsen | 415/169.1 |
| 4,877,368 | 10/1989 | Timperi et al. | 415/143 |
| 4,971,519 | 11/1990 | Timperi | 415/143 |
| 4,981,413 | 1/1991 | Elonen et al. | 415/169.1 |

*Primary Examiner*—Edward K. Look
*Assistant Examiner*—Christopher M. Verdier
*Attorney, Agent, or Firm*—Cohen, Pontani & Lieberman

[57] ABSTRACT

A liquid ring vacuum pump includes a vacuum pump housing composed by two opposed end walls spaced by an annular wall defining a vacuum pump chamber; a shaft extends into the vacuum pump chamber; a rotor is mounted on the shaft and is arranged eccentrically in the chamber; the rotor includes a rotor central portion and a plurality of vacuum pump vanes extending therefrom toward the annular wall; the rotor central portion and the vanes having at least one lateral edge adjacent the end walls facing the annular wall, the lateral edges and the end walls form a clearance therebetween; and the clearance between the edges and at least one of the adjacent end walls of the vacuum pump chamber increases towards the annular wall. A combination of the liquid ring vacuum pump with a centrifugal pump for pumping multi-phase liquids such as gas and solids containing fiber suspensions of the pulp and paper industry is also provided.

15 Claims, 3 Drawing Sheets

LIQUID RING PUMP HAVING TAPERED BLADES AND HOUSING

FIELD OF THE INVENTION

The present invention relates to a rotary pump such as a liquid-ring pump and, specifically, to a liquid-ring pump having a tapered radially vaned impeller or a tapered pump housing.

BACKGROUND AND SUMMARY OF THE INVENTION

Liquid-ring pumps are well known, such as, for example, a water-type pump in which a rotating ring of water in an eccentrically disposed chamber has a piston-like action producing suction for pumping either air or water. Pumps of the liquid-ring type are manufactured by the Nash Engineering Company of Norwalk, Connecticut, U.S.A. To operate a liquid-ring pump, the vacuum pump housing is partially filled with working liquid, generally water. A radially vaned impeller is eccentrically disposed with respect to the vacuum pump housing and upon rotation, the working liquid is thrown toward the periphery of the housing where it will form a liquid ring. The liquid ring seals the space between the rotor vanes and the housing. As the rotor rotates, the liquid ring moves away from the hub or rotor central portion thereby increasing the space in the pumping chamber. This, in turn, will draw the medium to be pumped into the chamber through the inlet port adjacent the rotor. As the rotor continues to rotate, the medium, mostly gas present between the vanes of the rotor is compressed by the liquid ring and is expelled through the discharge port. A continuous supply of working liquid is necessary to prevent an increase in temperature in the pump and to replenish the working liquid which is continuously discharged together with the gas through the discharge port. The major advantage of a liquid-ring pump is that it has only one movable part, the rotor. Such liquid-ring pumps have recently been used in connection with a centrifugal pump for the pumping of fiber suspensions such as paper pulp, at medium consistency, that is at about 6–15% solids consistency. Typically, such pumps utilize a separate vacuum pump, piping from the centrifugal pump to the vacuum pump, a separate motor and motor mount for the vacuum pump etc., in order to exhaust the gas which has been separated from the gas containing medium so that the suspension may be effectively pumped by the centrifugal pump impeller.

U.S. Pat. No. 3,230,890 discloses a centrifugal pump for removing gas from low consistency suspensions or from water having either a built-in vacuum pump or an external vacuum pump.

A fluidizing centrifugal pump for the pumping of gas containing medium consistency fiber suspensions having a built-in vacuum pump is disclosed in U.S. Pat. No. 4,776,758.

Various problems have, however, been encountered with the pump in operation today. For example, the air removal capacity has been significantly lower than required, i.e. the vacuum created has not reached a sufficiently high level. Also, the discharge pressure of the vacuum pump has been found to be too low. In some cases, it is desired to introduce the material discharged from the vacuum pump, mainly a mixture containing gas but also some fibers, into the top portion of a mass tower to recover the fibers. If, however, the discharge pressure of the vacuum pump is too low, the pumped material cannot be conveyed to the top of the mass tower, and an additional vacuum pump must be installed for that purpose. Also, the open annular volume in the common wall between the liquid-ring vacuum pump chamber has a tendency to become clogged by the fibers.

In the known pump, the axial gap between the vanes of the vacuum pump rotor and the axially adjacent walls of the vacuum pump housing are not adjustable but are positioned at a distance or clearance of about 0.4 mm. The reason for such relatively large clearance is the fact that there are a number of factors which render it impossible to further decrease the clearance as the various components of the pump are installed on the shaft or around the shaft starting from the drive end of the shaft. Thus, the dimensions of the components affect the clearance. The result of too wide a clearance is, of course, excess leakage and an insufficient vacuum. Another reason for the wide clearance may also be the fact that the shaft of the pump tends to flex somewhat during the operation creating the risk of mechanical contact between the vacuum pump vanes and the housing walls. Thus, the large clearance has been provided intentionally to ensure proper and long lasting operation of the pump.

The pump in accordance with the present invention is designed to eliminate the above mentioned problems. Accordingly, the pump of the present invention is constructed so that the clearance between the rotor vanes from at least one adjacent side wall of the vacuum pump chamber is greater at the tip thereof than near the rotor central portion. This may be achieved by either providing rotor vanes which taper in radial direction from the rotor central portion towards the tip of the vane and leaving the opposed vacuum pump chamber side walls substantially perpendicular to the direction of the shaft or by providing at least one tapered side wall so that the clearance between the rotor vanes and said side wall increases in the direction from the rotor central portion towards the tip of the rotor vanes. Of course, a combination of tapered rotor and tapered side wall is also possible. Also, one or more of the outer edges of the rotor vanes may taper in one direction and one or more outer vane edges may taper in opposite direction so that the distance between the respective surfaces of revolution of the outer edges of the vanes decreases from the rotor central portion to the tips of the vanes. In a further embodiment some of the vanes may have parallel side edges but are of shorter radial length while other vanes are tapered only from about the point which extends in radial direction beyond the length of the first vanes. In other words, the vanes are of different length, possibly alternating long and short and the longer vanes are outwardly tapered only in the area which extends beyond the shorter vanes in radial direction.

In addition, ports for the admission of make-up air for the control of the vacuum pump may be provided at the rear wall of the vacuum pump. By rear wall of the vacuum pump is meant that wall which is located opposite the suction inlet port and, if the pump is used in connection with a centrifugal pump as further described below, the rear wall of the vacuum pump is the wall opposite the air inlet port and distal the centrifugal pump housing.

The vacuum pump of the present invention may also be provided with means for introducing a liquid into the pump for flushing the pump and freeing the pump from fibers which otherwise tend to block the flow path of the pump and to supply working liquid to the liquid ring.

If the pump is used in combination with a centrifugal pump for pumping medium consistency fiber suspensions, the vacuum pump is preferably located on the same shaft as the centrifugal pump impeller behind an intermediate plate separating the centrifugal pump chamber from the vacuum pump chamber. The centrifugal pump impeller may be provided with a rotor with fluidizing blades either within the pump inlet entirely outside the pump inlet or with a combination thereof.

DETAILED DESCRIPTION OF THE DRAWINGS

DETAILED DESCRIPTION OF THE PRESENTLY PREFERRED EMBODIMENTS

Figure 1:
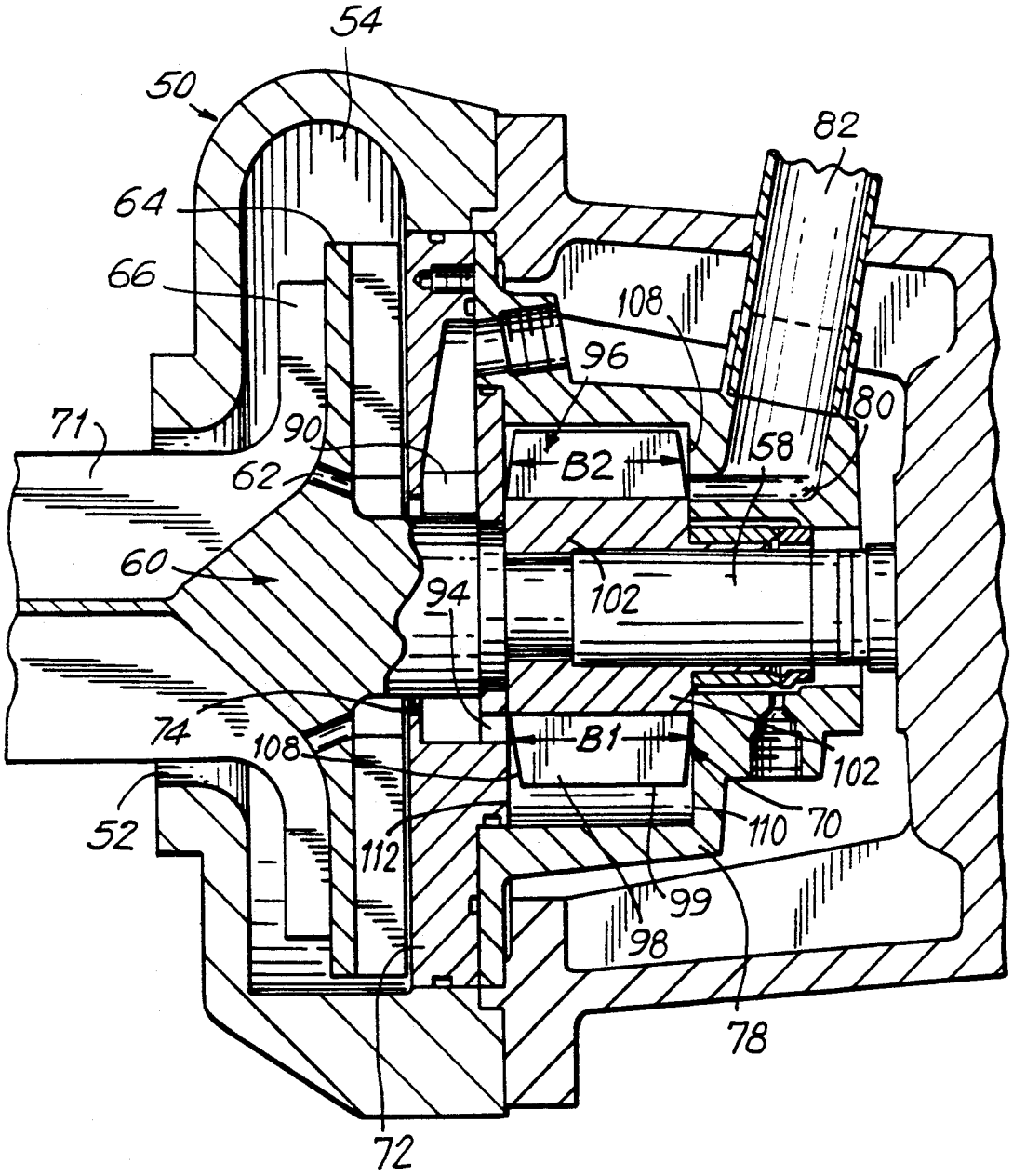
FIG. 1 is a partial cross-sectional view of a centrifugal pump including a liquid-ring pump embodying the present invention.

FIG. 1 shows a cross-sectional view of a liquid-ring pump of the above-mentioned type having a vacuum pump rotor 96 having a plurality of substantially radially extending vanes 98. Usually, the radially vaned rotor 96 is a one-piece stainless steel construction. Rotor 96 is mounted on shaft 58 extending through the vacuum pump housing 78 and being coupled to the shaft of a drive motor (not shown) in known manner. The vacuum pump housing is generally covered by a so-called head, a plate-like member sealing the vacuum pump chamber and usually containing the air inlet port and air discharge port therein. As shown in FIG. 1, the head is formed by intermediate plate 72 provided with an air inlet opening 74 and 94, respectively. The air outlet port is provided at the opposite side of the vacuum pump chamber at gas discharge opening 80.

The vacuum pump chamber 76 is thus formed by two opposed end walls 110 and 112 whereby chamber wall 112 is part of the intermediate plate 72 in the embodiment shown in FIG. 1. The liquid-ring pump is incorporated into a centrifugal pump for pumping gas containing fiber suspensions in the pulp and paper industry. Accordingly, intermediate plate 72 separates the centrifugal pump volute 54 from the vacuum pump chamber 76. A centrifugal impeller 60 is mounted on the end of shaft 58. Impeller 60 has a backplate 64 provided with one or more openings 62 therein for permitting air which has accumulated in front of the impeller to pass therethrough into the area behind the impeller backplate and from there through openings 74 and 94 into the vacuum pump. Impeller 60 is also provided with conventional pumping vanes but may also be provided with fluidizing blades extending through centrifugal pump inlet channel 52 and into the pulp containing vessel as schematically indicated at 71. Alternatively, the fluidizing blades 71 may also be mounted on a rotor in front of the impeller substantially coaxially with the pump inlet channel to extend only within the pulp containing vessel.

As pointed out above, conventional liquid-ring pumps are provided with a considerable clearance or gap between the lateral edges of the rotor vanes 98 and the respective end wall 110, 112 of the vacuum pump chamber. This measure generally is intended to account for the slight bending or flexing of the shaft during the operation of the pump, and particularly, if the shaft bearing units (not shown) are arranged at a distance from the vacuum pump rotor, which bending, in turn, creates the risk of mechanical contact between the vanes 98 and the end walls 110, 112, respectively.

According to the invention, there is provided a rotor comprising one or more rotor vanes 98 in which at least a portion of one radial edge facing one of end walls 110, 112 is tapered so that the axial length of said vane 98 is shorter at the tip thereof (B2) than in the vicinity of the rotor central portion 102 (B1) of the vacuum pump rotor 96. This has the effect of decreasing the clearance 108 between the rotor blade and the respective end walls 110, 112 in the direction from the tip of the vane 98 toward the shaft 58. For example, every second vane, all of the vanes or any appropriate number of vanes may be so tapered.

Figure 2:
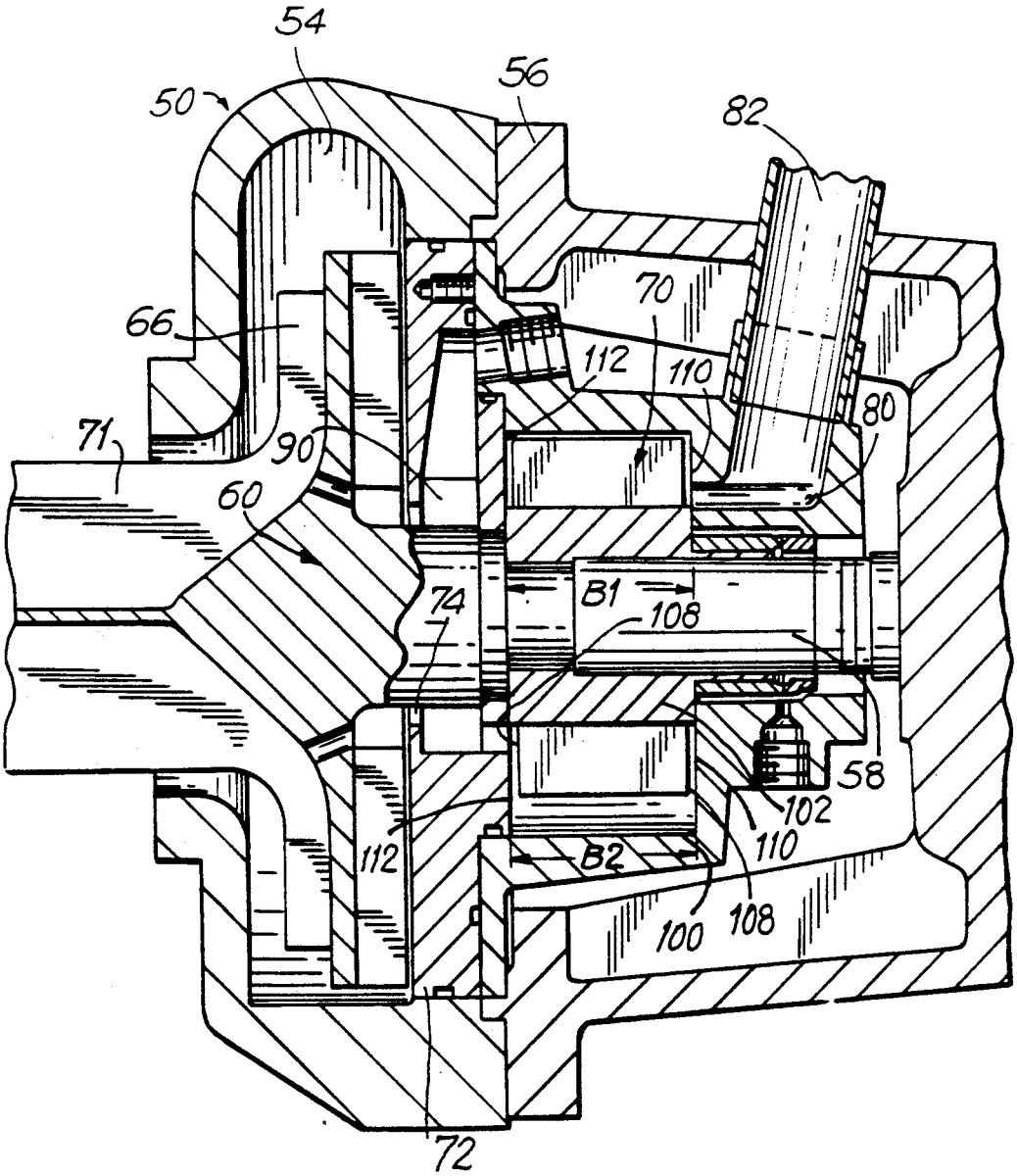
FIG. 2 is a partial cross-sectional view of a second embodiment of a liquid-ring pump in accordance with the present invention.

Alternatively, and as shown in FIG. 2, one or both end walls 110, 112 may be tapered so that the axial distance between the end walls 110, 112 increases from the vicinity or area of the rotor central portion !02 as indicated at B1, in radial direction as indicated at B2 representing the axial length of circumferential vacuum pump chamber wall 100 connecting end walls 110 and 112. In absolute terms, the clearance 108 between vacuum pump rotor 96 and end walls 110, 112 is increased by the same value irrespective of whether the rotor is tapered outwardly toward the tips thereof or the end walls are tapered inwardly from the circumferential wall toward the rotor central portion. Preferably, if one or both sides of the rotor are tapered, the vacuum chamber walls are substantially parallel and perpendicular to the axis of the shaft 58. On the other hand, if one or both of the vacuum pump chamber end walls are tapered as described, the lateral edge of the vacuum pump rotor vane is preferably maintained substantially parallel and perpendicular to the axis of the shaft. As mentioned above, a combination of tapered rotor blade and tapered end wall is also possible.

Figure 3:
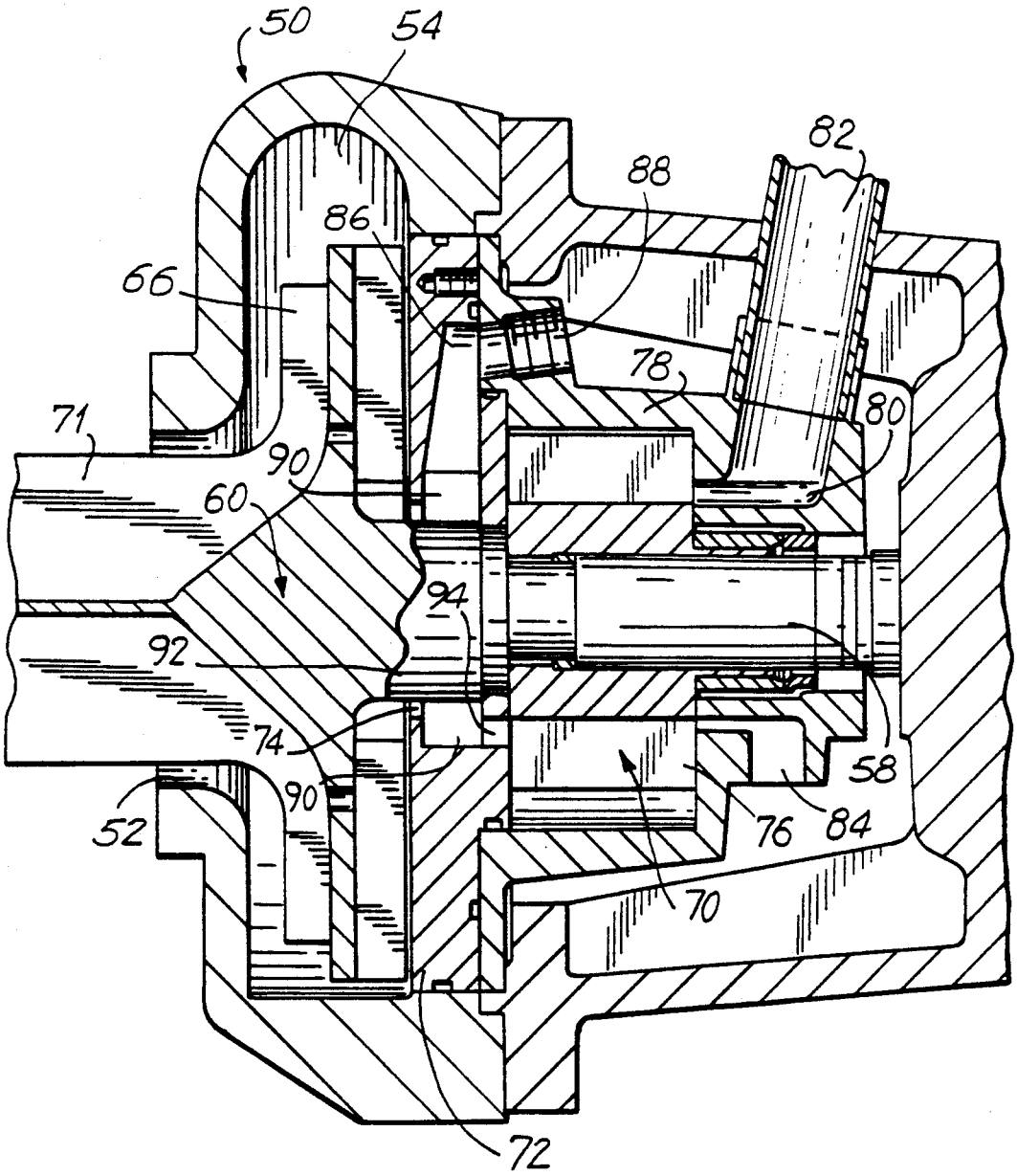
FIG. 3 is a partial cross-sectional view of another embodiment of the present invention.

As pointed out above, and as partially shown in FIGS. 1 and 2, if the vacuum pump of the present invention is used in connection with a centrifugal pump, the centrifugal pump housing 50 is attached to the pump frame 56 having at one end thereof the bearing assembly (not shown) for supporting the pump shaft 58 at the end of which the centrifugal impeller 60 is mounted. The centrifugal impeller 60 is further provided with front vanes, i.e. working vanes 66. Located between the bearing unit and the centrifugal impeller 60 is the sealing assembly (not shown). Vacuum pump 70 is separated from the volute 54, i.e. from the space housing the centrifugal impeller 60, by means of an intermediate plate 72 which also forms the head of the vacuum pump 70. In this embodiment, plate 72 has a central annular opening 74 for the shaft 58 and for permitting the gas to flow from the space behind the centrifugal impeller 60 to the vacuum pump 70, as described above. The vacuum pump housing 78 has, in addition to the eccentric chamber 76, a discharge port or pipe 80 for the gas connected to the pressure side of the chamber 76 (the upper side in FIG. 3) and leading to a gas discharge connection 82 on the outer surface of the housing. The housing 78 further has an additional air duct 84 leading to the eccentric chamber 76 at its suction side (the lower side in FIG. 3)

and at the back side of the vacuum pump chamber relative to its front side facing the head or intermediate plate 72. Duct 84 is for providing control or make-up air to the vacuum pump 70, i.e. for controlling the vacuum of the pump and for maintaining the vacuum at a constant level. It is to be noted that air duct 84 is dimensioned with respect to its diameter and length so that the vacuum pump 70 will readily receive additional air in case there is insufficient air contained in and separated from the suspension to be pumped. A control valve (not shown) for regulating the vacuum of the vacuum pump may be directly attached to the end of the make-up air duct 84.

In accordance with a further embodiment of the present invention (FIG. 3) the intermediate plate or head 72 is provided with a relative wide duct 86 for the introduction of a liquid such as flushing water or the like leading from the connection 88 on the vacuum pump housing or body 78 outer surface to a large open volume 90 within the plate and around the shaft 58 of the pump or around the extension sleeve 92 of the impeller 60. As stated, duct 86 is used for introducing a liquid such as water to the vacuum pump 70, for instance for feeding liquid to the liquid ring or for flushing either the vacuum pump 70, the air inlet 74, the open volume 90 and/or the inlet channel 94 to the vacuum pump 70 in case there are solids in these areas of the pump which must be removed to prevent clogging thereof.

Since these as well as further embodiments and modifications thereto are intended to be within the scope of the present invention, the above description should the construed as illustrative and not in a limiting sense, the scope of the invention being defined solely by the appended claims.

What is claimed is:

1. A liquid-ring vacuum pump comprising:

a vacuum pump housing comprising two opposed end walls (110, 112) spaced by an annular wall (110), said end walls and said annular wall defining a vacuum pump chamber (76);

a shaft (58) extending into said vacuum pump chamber (76);

a rotor (96) mounted on said shaft and being arranged eccentrically in said chamber; said rotor comprising a rotor central portion (102) and a plurality of vacuum pump vanes (98) extending therefrom toward said annular wall (100); said rotor central portion and having at least one lateral edge adjacent said end walls facing said annular wall (100), said lateral edges and said end walls forming a clearance (108) therebetween; and said clearance (108) between said edges and at least one of said adjacent end wall of said vacuum pump chamber (76) increasing toward said annular wall.

2. The liquid-ring pump as claimed in claim 1, wherein said vacuum pump vanes (98) have a tip (99) and a first axial length (B2) at said tip (99) and a second axial length (B1) in the vicinity of said rotor central portion (102); and wherein said first axial length (B2) is less than said second axial length (B1).

3. The liquid-ring pump as claimed in claim 2, wherein said vanes (98) are tapered so that their opposite lateral edges converge linearly towards said tips.

4. The liquid-ring pump as claimed in claim 1, wherein said vacuum pump chamber (76) has a first axial length (B1) within the region of said rotor central portion (102) and a second axial length (B2) at said tips of said vanes; and wherein said first axial length (B1) is less than said second axial length (B2).

5. The liquid-ring pump as claimed in claim 4, wherein at least one of said opposite end walls (110, 112) of said vacuum pump chamber (76) diverges outwardly away from said vacuum pump vanes (98).

6. A centrifugal pump comprising:

a centrifugal pump housing (50) having an inlet and an outlet for material to be pumped;

a centrifugal impeller mounted for rotation within said centrifugal pump housing;

a vacuum pump (70) adjacent said centrifugal pump housing;

an intermediate plate (72) separating said centrifugal pump housing from said vacuum pump;

said vacuum pump comprising:

a vacuum pump housing comprising two opposed end walls (110, 112) spaced by an annular wall (110), said end walls and said annular wall defining a vacuum pump chamber (76);

a shaft (58) extending into said vacuum pump chamber (76); a rotor (96) mounted on said shaft and being arranged eccentrically in said chamber; said rotor having a rotor central portion (102) and a plurality of vacuum pump vanes (98) extending therefrom toward said annular wall (100); said rotor central portion and said vanes having at least one lateral edge adjacent said end walls and a tip facing said annular wall (100), said lateral edges and said end walls forming a clearance (108) therebetween; and said clearance (108) between vane edges and at least one of said adjacent end wall of said vacuum pump chamber (76) being greater at said tip (99) thereof than in the vicinity of said rotor central portion (102).

7. The centrifugal pump as claimed in claim 6, wherein said vacuum pump vanes (98) have a first axial length (B2) at said tip (99) and a second axial length (B1l) in the vicinity of said rotor central portion (102); and wherein said first axial length (B2) is less than said second axial length (B1l).

8. The centrifugal pump as claimed in claim 7, wherein said vanes (98) are tapered so that said opposite lateral edges converge towards said tips.

9. The centrifugal pump as claimed in claim 6, wherein said vacuum pump chamber (76) has a first axial length (B1) within the region of said rotor central portion (102) and a second axial length (B2) at said tips of said vanes; and wherein said first axial length (B1) is less than said second axial length (B2).

10. The centrifugal pump as claimed in claim 6, wherein at least one of said opposite end walls (110, 112) of said vacuum pump chamber (76) diverges outwardly away from said vacuum pump vane (98).

11. The pump as claimed in claim 6, wherein said centrifugal impeller is mounted on the same shaft as said vacuum pump rotor and additionally comprising a fluidizing impeller mounted on said shaft in front of said centrifugal impeller.

12. The pump as claimed in claim 11, wherein said fluidizing impeller is located outside said pump inlet.

13. The centrifugal pump as claimed in claim 6, additionally comprising an open volume (90) within said intermediate plate (72); an opening (94) within said intermediate plate permitting communication between said volume (90) and said vacuum pump chamber (76); and means for introducing a liquid into at least one of said open volume (90) and said opening (94).

14. The pump as claimed in claim 13, additionally comprising a duct (88) within said vacuum pump housing (78) and communicating with said open volume (90) for permitting to introduce said liquid thereto.

15. The pump as claimed in claim 13, additionally comprising means within said end wall opposite said intermediate plate (72) for introducing make-up air into said vacuum pump chamber.

* * * * *